US006666449B2

(12) United States Patent
DeFosse et al.

(10) Patent No.: US 6,666,449 B2
(45) Date of Patent: Dec. 23, 2003

(54) STAR WHEEL SURFACE ENHANCEMENT AND PROCESS OF MANUFACTURE

(76) Inventors: Stephen Francis DeFosse, 4716 Matthew Ct., Lexington, KY (US) 40514; Edward Lawrence Kiely, 700 Rainwater Dr., Lexington, KY (US) 40515; Sean David Smith, 3408 Fox Dr., Lexington, KY (US) 40515

( * ) Notice: Subject to any disclaimer, the term of this patent is extended or adjusted under 35 U.S.C. 154(b) by 97 days.

(21) Appl. No.: 09/855,327

(22) Filed: May 15, 2001

(65) Prior Publication Data

US 2002/0171198 A1 Nov. 21, 2002

(51) Int. Cl.[7] ..... B65H 29/00
(52) U.S. Cl. ..... 271/187; 271/315
(58) Field of Search ..... 271/187, 315, 271/83; 205/660

(56) References Cited

U.S. PATENT DOCUMENTS 2,868,705 A * 1/1959 Baier et al. ..... 205/680
3,591,468 A * 7/1971 Nishio et al. ..... 205/179
3,945,893 A 3/1976 Ishimori et al.
5,066,370 A * 11/1991 Andreshak et al. ..... 205/651
5,115,740 A 5/1992 Emrich et al.
5,163,674 A 11/1992 Parks
5,356,231 A 10/1994 Nakamura et al.
5,406,318 A * 4/1995 Moore et al. ..... 347/70
5,560,726 A 10/1996 Kawaguchi
5,912,690 A 6/1999 Endo et al.
6,007,063 A 12/1999 Park

* cited by examiner

*Primary Examiner*—Donald P. Walsh
*Assistant Examiner*—Joseph Rodriguez
(74) *Attorney, Agent, or Firm*—Todd T. Taylor, Esq.; D. Brent Lambert, Esq.

(57) ABSTRACT

A star wheel manufacturing process, and a star wheel manufactured thereby, suitable for an ink jet printer. Metal is formed by chemical milling, subtractive etching or the like, into the desired star wheel configuration, including a plurality of radially extending projections having tips. At least a portion of each tip has an electropolished surface. A coating of fluorinated polymer or the like may be applied to at least a portion of the electrolpolished surface on each tip.

8 Claims, 3 Drawing Sheets

STAR WHEEL SURFACE ENHANCEMENT AND PROCESS OF MANUFACTURE

BACKGROUND OF THE INVENTION

1. Field of the Invention

The present invention relates generally to ink jet printers and more particularly, the invention pertains to star wheels, and a manufacturing process for star wheels provided as part of the media transport path in for a high speed ink jet printer.

2. Description of the Related Art

Ink jet printers are used commonly in offices and home printing applications. Ink jet printers are popular due to their low cost of operation, low energy use and quiet operating features. Ink jet printing involves ejection of tiny ink droplets through small holes, in a controlled manner, to create the desired image. Ink is supplied from an ink reservoir to a printing head, which includes various passageways from the reservoir to the nozzle orifices. Energy is applied to the ink from an ink droplet generator near each orifice, which may include the application of electrostatic attraction, the application of oscillating forces from piezo elements, the application of heat from heating elements, or the like.

Controlling the media in the print zone is critical, in order to provide proper positioning of the print media for the reception of ink droplets applied by the printhead. It is known to use star wheels opposite exit drive wheels in opposed roll couples, to prevent media from buckling in or around the print zone. As implied by their name, star wheels have a plurality of radially extending tips on the periphery thereof, which engage the surface of a printed sheet passing between the star wheel and the opposed drive roller.

Laser printers are also used in both home and office applications. Although generally more costly than ink jet printers, laser printers are sometimes preferred for the perceived greater print quality and the faster printing speed available from laser printers.

For ink jet printers to compete more favorably with laser printers, it is necessary to increase the printing speed and the optical density of the printed image obtained from an ink jet printer. These performance increases in an ink jet printer must be achieved without increased occurrence of ink smear.

Improved ink formulations have been developed, and incorporate binders and flocculants to eliminate smear and provide an optical density for the printed image approaching that available with laser printers. While quick dry times are available, increased printing speeds in ink jet printers can result in still wet ink being present as the sheet exits the printer. Ink may be transferred to the tips of the star wheels, as the star wheel tracks over the printed surface. Paper dust and fibers can accumulate, together with the ink, into a mass on the star wheel tip. A mechanical lock occurs between the star wheel surface and the mixture of ink, dust and fiber. The accumulation at the star wheel tip acts as a sponge, absorbing additional ink from wet portions of printed media passing thereunder. The absorbed ink can be re-deposited on non-printed areas of the sheet contacted by the accumulation at the star wheel tip. Print quality is degraded not so much by the removal of ink from the printed area, but by the redeposit of ink on the unprinted areas of the media.

It is necessary to make the star wheel from material of sufficient resistance to withstand the abrasion from paper over time. Selecting material of initially lower surface resistance can reduce the propensity for ink to adhere to the wheel, and the subsequent mechanical lock between the star wheel surface and the accumulation of ink, fiber and dust. However, such materials generally are prone to wear more rapidly, creating surface roughness and an increasing propensity for ink to adhere to the star wheel. Coating star wheels formed by chemical etching is unsatisfactory in that the coating deposition is not uniform on the relatively rough surface of a chemically etched star wheel. Manufacturing techniques other than chemical etching can be used to yield better surface finishes; however, the increased manufacturing cost makes the use of these techniques undesirable.

What is needed in the art is a star wheel, and a manufacturing process for making a star wheel, which can withstand the abrasion created by contact with paper over time, yet which has a smooth finish reducing the tendency for ink to adhere to the star wheel tip surface.

SUMMARY OF THE INVENTION

The present invention provides a manufacturing process for making star wheels suitable for ink jet printers, which yields star wheels having improved surface smoothness, with the optional application of coatings having consistent thickness.

The invention comprises, in one form thereof, a method for forming a printer star wheel. The method includes steps of providing metal to be used in the star wheel; forming the metal into the desired star wheel shape; and electropolishing at least a portion of the star wheel.

The invention comprises, in another form thereof, a star wheel having a metallic body; a plurality of radially extending projections having tips; and at least a portion of the tips having an electropolished surface.

The invention comprises, in yet another form thereof, an ink jet printer having a print station and a paper transport path therethrough. The paper transport path includes a star wheel for engaging printed surfaces of media exiting the print station. The star wheel has a plurality of projections, and an electropolished surface on the projections.

An advantage of the present invention is that known, acceptable material can be used for manufacturing a star wheel, and treated with an economically advantageous process to reduce the propensity for ink, fiber and dust to adhere to the star wheel.

Another advantage of the present invention is providing a star wheel for an ink jet printer which is resistant to wear from long-term contact with paper, and which resists the accumulation of ink at the star wheel tips even after prolonged contact with wet ink on printed media surfaces.

Yet another advantage of the present invention is providing a high-speed ink jet printer having reduced ink tracking from star wheel contact with the printed surface of freshly printed media.

Still another advantage of the present invention is providing a process for applying a smooth, consistent coating to a metal object, such as a printer star wheel, and providing a printer star wheel having a coating of acceptable thickness consistency.

A further advantage of the present invention is providing a star wheel structure in which any accumulation of ink, dust and fiber tends to occur away from the tips of the star wheel, and away from the portions of the star wheel which come into contact with media passing thereunder.

BRIEF DESCRIPTION OF THE DRAWINGS

The above-mentioned and other features and advantages of this invention, and the manner of attaining them, will become more apparent, and the invention will be better understood by reference to the following description of embodiments of the invention, taken in conjunction with the accompanying drawings, wherein.

Corresponding reference characters indicate corresponding parts throughout the several views. The exemplifications set out herein illustrate one preferred embodiment of the invention, in one form, and such exemplification is not to be construed as limiting the scope of the invention in any manner.

DETAILED DESCRIPTION OF THE INVENTION

Figure 1:
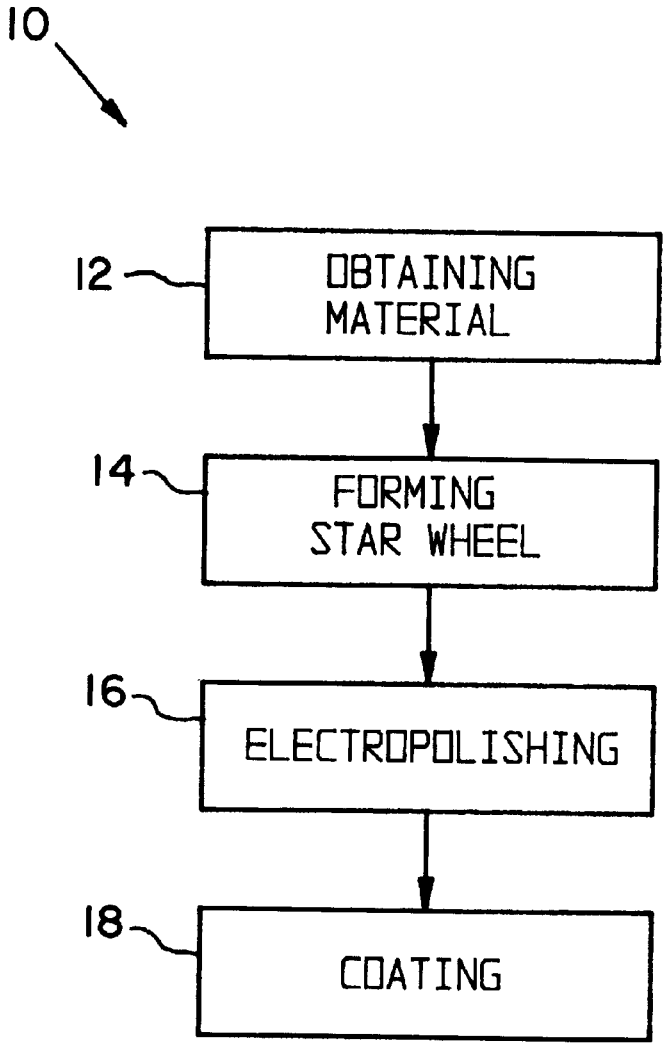
FIG. 1 is a flow diagram of a manufacturing process for creating a star wheel having improved tip surfaces in accordance with the present invention.

Referring now to the drawings, and more particularly to FIG. 1, there is shown a manufacturing process 10 for the formation of a star wheel 30 (FIG. 4), in accordance with the present invention.

As illustrated in FIG. 1, process 10 includes a first step 12 of obtaining material from which the star wheel will be made. A second step 14 involves forming the star wheel by any of several techniques. A third step 16 comprises electropolishing the star wheel. A fourth step 18 comprises coating the electropolished star wheel.

First step 12, obtaining material from which the star will be made, generally includes selecting and providing appropriate material, normally a metal. The material selected should have sufficient wear resistance to withstand the abrasion from paper which occurs from long-term contact with different types of paper and other media that may be processed in a printer. Many metals used for star wheels in the past are appropriate for use in practicing the method of the present invention.

Second step 14, forming the star wheel, can comprise any of several known formation techniques. These may include chemical milling or subtractive etching away of undesired material, leaving behind the desired star wheel configuration or shape, having dimensions within accepted tolerances for the star wheel. A formed star wheel 30 (FIG. 3) will normally include a body 32 having radially extending projections 34, having distal ends forming tips 36 at the outer periphery of star wheel 30. Advantageously, the forming step will yield the smoothest possible surface at reasonable manufacturing expense and complexity.

Third step 16, electropolishing the star wheel, provides a further smoothened surface 38 of star wheel 30. Electropolishing reduces the surface resistance and minimizes the surface irregularities on surface 38 to which accumulated ink, fiber and dust may otherwise create a mechanical lock.

Electropolishing is a known technique for providing mirror-like finishes on metal surfaces. An originally rough and dull metal surface can be smoothed and polished to a smooth and shiny surface, without the need for surface working machines and further mechanical abrasion of the metal piece. In the typical electropolishing process, the metal object to be electropolished is immersed in an electrolytic bath, that is, a current conducting liquid. The process is one in which metal surface irregularities are removed by anodic dissolution in the suitable electrolyte for the material being worked. Electropolishing is essentially the reverse process of electroplating. Instead of the deposition of metal on a base metal as in electroplating, in the electropolishing process the work piece is made the anode and tends to be dissolved during the process.

In a typical electropolishing apparatus, a polishing cell contains a circulating pump and the appropriate electrolytic solution for the material being worked. For many metals, acids have been found to be appropriate electrolytic solutions. Pumping the solution, agitating the solution and heating the solution are all variations which may or may not be used, depending upon the material being treated and the electrolyte being used. A direct current (d.c.) power source is provided. An electric field is created between the work piece, as the anode, and an electrode within the same electrolyte. The electrode is resistive to chemical interaction with the electrolyte. Surface metal from the piece being treated goes into solution. The electrical potential accentuates the metal removal at the micro peaks of the surface irregularities of the treated piece. At the same time, less reaction occurs in the micro valleys, where reactions are more difficult. The desired result is chemical removal over the entire surface, to polish the entire surface, but more accentuated removal at the ridges or peaks than in the valleys. Thereby, a substantially smoother surface is obtained, with the entire surface being polished. Electrical amperage and voltage; the process exposure time; the electrolytic concentration and make-up, specific gravity, acidity, and temperature can all be adjusted to maximize the differential treatment of micro valleys verses micro peaks, to obtain the desired smoothness and brightness in the final product. By eliminating mechanical abrasion during the polishing process, micro grooving is eliminated.

For process simplicity, it may be desirable to place a plurality of star wheels 30 at spaced intervals on, and electrically connected to an electrically conductive rod appropriately connected in the electrical circuit. The assembly may then be immersed in the suitable electrolytic bath, and electropolished appropriately. However, it is not always necessary to electropolish the entire star wheel 30. It is necessary only to electropolish a portion of surface 38 of star wheel tips 36, generally the area coming into contact with the sheet and a small area immediately adjacent thereto radially inwardly on projections 34.

Figure 2:
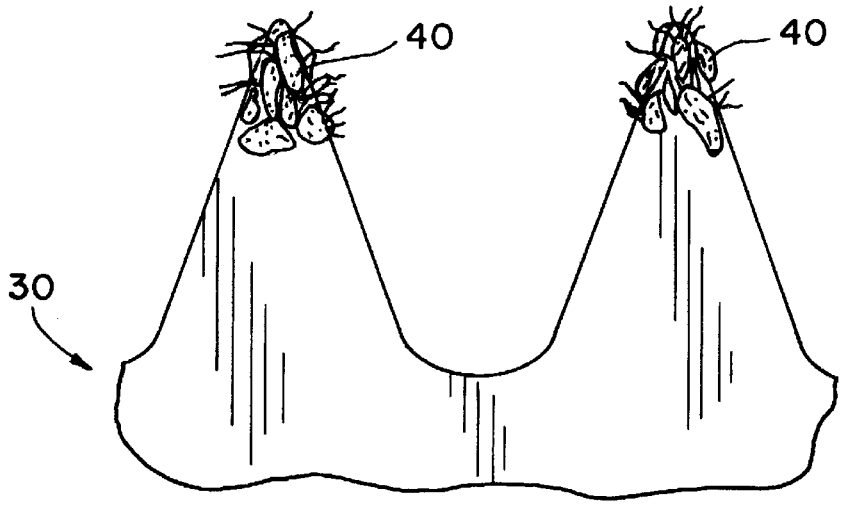
PRIOR ART Fig. 2
FIG. 2 is a perspective view of prior art star wheel tips illustrating the accumulation of ink and debris.
Figure 3:
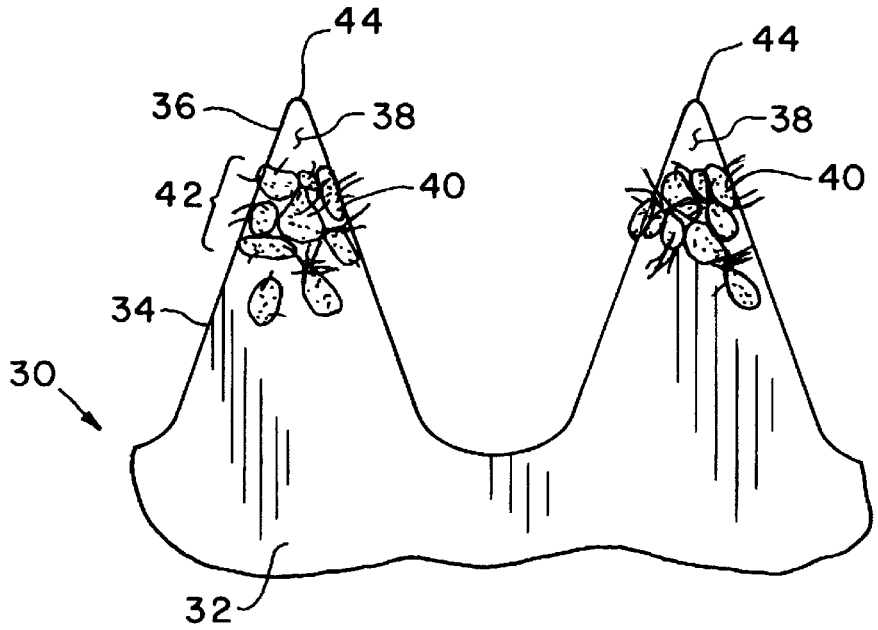
FIG. 3 is a perspective view of tips of a star wheel manufactured in accordance with the present invention.
Figure 4:
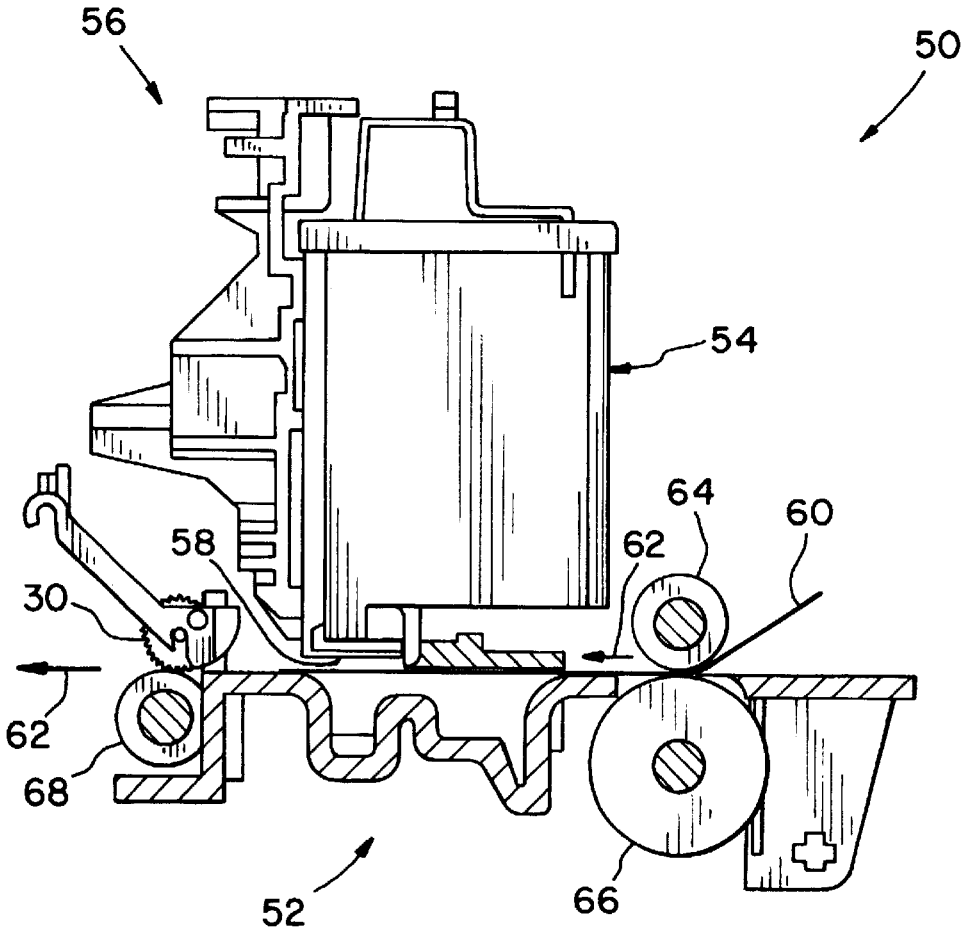
FIG. 4 is a cross-sectional view of a printer print station in which a star wheel of the present invention is used.

FIG. 2 illustrates a star wheel 30 similar to that shown in FIGS. 3 and 4, but not having electropolished surface 38. As illustrated in FIG. 2, the micro irregularities of the nonpolished star wheel facilitate a mechanical lock between dried ink particles, dust and fibers, indicated in FIGS. 2 and 3 as debris 40. After a period of time, debris 40 accumulates at star wheel tips 36, creating a sponge-like, absorbent agglomeration. This accumulation may absorb still wet ink from media passing beneath star wheel 30, as each tip 36 engages the sheets passing from a printer print station. Subsequently, the ink can be transferred to non-printed areas of the same or subsequent sheets, as a sheet passes under the star wheel and the accumulated sponge-like concentration comes in contact with non-printed areas of the sheet.

In accordance with the present invention, however, as illustrated in FIG. 3, due to the enhanced smoothness of surface 38 obtained from electropolishing at least a portion star wheel tips 36, the accumulation of ink, dust and fiber does not cling to tips 36. Instead, the accumulation is pushed upwardly on projections 34, to a radially inward area 42 remote from an outer-most end 44 of each tip 36. Even if an accumulation occurs in the general region of area 42, away from end 44, the accumulation will not come in contact with a sheet engaged by star wheel 30. Therefore, an accumulation of debris 40 and will neither absorb ink nor transfer the ink to non-printed areas of the same or subsequent sheets engaged by star wheel 30.

Although electropolishing alone may be sufficient to overcome the problems previously associated with ink transfer and tracking, even greater improvements can be made through the application of suitable coatings to the electropolished star wheel. It should be noted that, generally, coating alone is not an adequate solution to ink tracking problems. Coating the formed star wheel, without first electropolishing the star wheel, does provide some improvements over the uncoated, unpolished star wheel. However, coating application is not consistent, and irregularities in the star wheel surface remain after coating, and may even be accentuated. However, by first electropolishing the surface to be coated, the deposition of coating is more uniform throughout the electropolished surface.

Fourth step 18, coating the electropolished star wheel, includes the application of a coating having sufficient abrasion resistance to further reduce the attraction and grip of the star wheel to dried ink, dust, fiber and other debris. In the preferred embodiment of the invention, a fluorinated coating is applied via a plasma polymerization process to further reduce the ink tracking observed on print samples and to delay the onset of tracking. Plasma polymerization involves equally spacing the star wheels within a plasma reactor. Gaseous monomeric reactants are introduced into the reactor chamber, with a carrier gas, under controlled conditions. Oligimeric and polymeric species form in the gas phase and deposit on the surface of the star wheel. Some chemical attraction may occur between the polymer coating and the metal surface of the star wheel. The thickness of the coating film can range from fifty angstroms to several microns. The reactants can be varied both in form and concentration to yield surfaces that lower adhesion between the coating surface and debris 40, and/or to improve abrasion resistance. An appropriate abrasion resistant coating can compensate for the use of a base material of less abrasion resistance. While a fluorinated coating applied via a plasma polymerization is preferred, other coatings may be used.

For process simplicity, it may be desirable to electropolish the entire star wheel, and to subsequently coat the entire star wheel with the desired coating. However, as previously explained, it is necessary only to electropolish a region at the tips 36 of star wheel 30. Similarly, it is necessary to coat only the electropolished area. However, it again may be preferred for process simplicity to coat the entire star wheel, even when only a portion of each tip 36 of star wheel 30 has been electropolished. It is not of significant consequence if the coating is not evenly applied on the surfaces which have not been electropolished, so long as the electropolished surfaces are properly coated.

A printer 50 in which a star wheel 30 of the present invention may be used advantageously is illustrated in FIG. 4. Printer 50 includes a print station 52 having an ink cartridge 54 on a cartridge carrier 56. An array of ink nozzles (not shown) are provided in a nozzle plate 58, to selectively eject droplets of ink on a media sheet 60 being printed in printer 50. Media sheet 60 can be a sheet of paper, an envelope, transparency or other media type for which printer 50 is adapted. A drive system (not shown) including a motor, belts, guide rail and the like are provided to move cartridge carrier 56 transverse to the direction at which media sheet 60 is fed through printer 50. The operation of print station 52 is known to those skilled in the art, and will not be described in further detail herein.

Printer 50 includes a media transport path, designated by arrows 62, by which a media sheet 60 to be printed is guided from a paper supply tray (not shown) through print station 52, and to a stacker bin (not shown). Pairs of feed rollers 64 and 66 feed media sheets 60 through print station 52. A plurality of star wheels 30 cooperate with a plurality of feed rollers 68 to feed printed media sheets 60 from print station 52. Star wheels 30 engage the printed side of media sheet 60. In accordance with the present invention, even if projections 34 encounter still-wet ink from print station 52, smooth surfaces 38 of tips 36 at the distal ends of projections 34 resist the formation of a mechanical lock between surface 38 and debris 40. Any agglomeration of debris 40 is moved away from ends 44 of tips 36, to areas 42 where the accumulation of debris is operationally insignificant.

The present invention provides a manufacturing process for star wheels, and star wheels manufactured thereby, with improved surface smoothness, for decreased debris accumulation and reduced ink tracking. The process facilitates the application of coatings of consistent thickness.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A star wheel comprising:

a metallic body;

a plurality of radially extending projections from said body, each said projection having a tip on a distal end thereof; and at least a portion of each of said projections having an electropolished surface.

2. The star wheel of claim 1, including a coating on at least a portion of said electropolished surface of each of said projections.

3. The star wheel of claim 2, said coating being a fluorinated polymer.

4. The star wheel of claim 3, said electropolished surface being on only said tips of said projections.

5. An ink jet printer comprising:

a print station including a media transport path therethrough;

a star wheel in said media path engaging printed surfaces of media exiting said print station; and said star wheel having a plurality of projections, each said projection having an electropolished surface.

6. The printer of claim 5, each said electropolished surface having a surface coating thereon.

7. The printer of claim 6, said coating being a fluorinated polymer.

8. The printer of claim 5, said electropolished surface being on only a distal end of each said projection.

* * * * *